US010538971B2

(12) United States Patent
Akhmadi Eko et al.

(10) Patent No.: US 10,538,971 B2
(45) Date of Patent: Jan. 21, 2020

(54) DRILL BIT INSERT AND DRILL BIT

(71) Applicant: MITSUBISHI MATERIALS CORPORATION, Tokyo (JP)

(72) Inventors: Wardoyo Akhmadi Eko, Naka-gun (JP); Toshihiko Matsuo, Naka-gun (JP); Chihiro Sakurazawa, Tsukuba (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 176 days.

(21) Appl. No.: 15/558,518

(22) PCT Filed: Mar. 17, 2016

(86) PCT No.: PCT/JP2016/058446
§ 371 (c)(1),
(2) Date: Sep. 14, 2017

(87) PCT Pub. No.: WO2016/148223
PCT Pub. Date: Sep. 22, 2016

(65) Prior Publication Data

US 2018/0080285 A1 Mar. 22, 2018

(30) Foreign Application Priority Data

Mar. 19, 2015 (JP) ..... 2015-056106
Mar. 16, 2016 (JP) ..... 2016-051788

(51) Int. Cl.
*E21B 10/55* (2006.01)
*E21B 10/567* (2006.01)

(52) U.S. Cl.
CPC ..... *E21B 10/5673* (2013.01)

(58) Field of Classification Search
CPC ..... E21B 10/56; E21B 10/36; E21B 10/46; E21B 10/567; B22F 7/062; B22F 2005/001; C22C 26/00
See application file for complete search history.

(56) References Cited

U.S. PATENT DOCUMENTS 4,694,918 A 9/1987 Hall
6,260,640 B1 7/2001 Einset et al.
(Continued)

FOREIGN PATENT DOCUMENTS

CN 102528104 A 7/2012
JP 2002-097884 A 4/2002
(Continued)

OTHER PUBLICATIONS

International Search Report dated Jun. 7, 2016 for the corresponding PCT Application No. PCT/JP2016/058446.
(Continued)

*Primary Examiner* — Brad Harcourt
(74) *Attorney, Agent, or Firm* — Leason Ellis LLP

(57) ABSTRACT

A drill bit insert attached to a tip portion of a drill bit to perform drilling, includes: an insert body (1) that includes: a rear end portion buried in a bit body of the drill bit; and a tip portion protruding from a surface of the drill bit and tapered toward a tip side of the insert body, in which a surface of at least the tip portion of the insert body (1) made of polycrystalline cubic boron nitride compact (4) sintered using a catalytic metal containing Al and at least one selected from the group consisting of Co, Ni, Mn, and Fe and containing 70 vol % to 95 vol % of cubic boron nitride.

8 Claims, 2 Drawing Sheets

(56) References Cited

U.S. PATENT DOCUMENTS

| | | | | |
|---|---|---|---|---|
| 6,651,757 | B2 | 11/2003 | Belnap et al. | |
| 7,347,292 | B1 | 3/2008 | Hall et al. | |
| 2006/0166615 | A1* | 7/2006 | Tank | B22F 7/06 451/540 |
| 2011/0024201 | A1* | 2/2011 | Scott | E21B 10/567 175/428 |
| 2015/0151409 | A1* | 6/2015 | Vaughn | B24D 18/0009 51/309 |

FOREIGN PATENT DOCUMENTS

| | | | |
|---|---|---|---|
| JP | 2002-349173 | A | 12/2002 |
| JP | 2004-026555 | A | 1/2004 |
| JP | 2010-512300 | A | 4/2010 |
| JP | 2010-247262 | A | 11/2010 |
| JP | 2012-206902 | A | 10/2012 |
| WO | WO 2008/072180 | A | 6/2008 |
| WO | WO-2014/191555 | A | 12/2014 |

OTHER PUBLICATIONS

Office Action dated Sep. 25, 20185 for the corresponding Chinese Patent Application No. 201680015923.1.

Extended European Search Report dated Aug. 3, 2018 for the corresponding European Patent Application No. 16765052.2.

Office Action dated Sep. 25, 2018 for the corresponding Chinese Patent Application No. 201680015923.1 (Copy previously submitted in the IDS filed Nov. 30, 2018).

Office Action dated Jun. 19, 2019 for the corresponding Chinese Patent Application No. 201680015923.1.

* cited by examiner

DRILL BIT INSERT AND DRILL BIT

CROSS-REFERENCE TO RELATED PATENT APPLICATIONS

This application is a U.S. National Phase application under 35 U.S.C. § 371 of International Patent Application No. PCT/JP2016/058446 filed on Mar. 17, 2016 and claims the benefit of Japanese Patent Applications No. 2015-056106 filed on Mar. 19, 2015 and No. 2016-051788 filed on Mar. 16, 2016, all of which are incorporated herein by reference in their entirety. The International Application was published in Japanese on Sep. 22, 2016 as International Publication No. WO/2016/148223 under PCT Article 21(2).

FIELD OF THE INVENTION

The present invention relates to a drill bit insert attached to a tip portion of a drill bit to perform drilling and a drill bit in which such drill bit insert is attached to a tip portion thereof.

BACKGROUND OF THE INVENTION

As such a drill bit insert, a drill bit insert having: an insert body made of a cemented carbide; and a hard layer made of a sintered compact of polycrystalline diamond harder than the insert body and coated on a tip portion of the insert body in order to increase the tool life of a bit for percussion drilling, is known. For example, U.S. Pat. No. 4,694,918 proposes a drill bit insert having: an insert body including a cylindrical rear end portion and a hemispherical tip portion with the outer diameter reduced toward a tip side; and many layers of hard layer of the polycrystalline diamond compact coated on the tip portion of the insert body. U.S. Pat. No. 6,651,757 proposes a polycrystalline diamond compact to which a carbide such as WC is added so as to adjust a hardness thereof.

Technical Problem

Although having higher wear resistance, the polycrystalline diamond compact has lower toughness and thus has poor fracture resistance compared to a cemented carbide. Therefore, the hard layer may chip or be fractured unexpectedly during drilling of a super-hard rock layer. In a case where the hard layer is fractured and thus the cemented carbide body is exposed, wear of the drill bit insert is promoted at once and the tool life of the drill bit is reduced. Accordingly, the drill bit should be frequently exchanged with new one and thus work efficiency is significantly reduced.

In addition, in the method of increasing toughness by adjusting hardness by adding a carbide or a nitride to a polycrystalline diamond compact as described in U.S. Pat. No. 6,651,757, there is a tendency that bonding between diamond particles decreases and thus hardness is impaired even though toughness is improved. Furthermore, a diamond compact cannot be used in Fe or Ni mines due to its high affinity. The diamond compact has the heat resistant temperature of approximately 700° C. and thus cannot be used in a condition where it is exposed to a temperature higher than 700° C. In addition, since a diamond compact has high hardness, it is difficult to resharpen and effectively reuse a drill bit insert with a hard layer worn to some extent.

The present invention is made under such a background, and an objective thereof is to provide a drill bit insert with a long tool life which has hardness comparable to a polycrystalline diamond compact to retain wear resistance, has high toughness and excellent fracture resistance, can be used in Fe or Ni mines or under a high-temperature drilling condition, and can be effectively reused by resharpening, and to provide a drill bit which has the drill bit insert attached thereto, has a long tool life, and can efficiently perform drilling.

SUMMARY OF THE INVENTION

In order to solve the above problem and to achieve such an objective, a drill bit insert according to an embodiment of the present invention (hereinafter, referred to as "drill bit insert of the present invention") attached to a tip portion of a drill bit to perform drilling, includes: an insert body including: a rear end portion buried in a bit body of the drill bit; and a tip portion protruding from a surface of the drill bit and tapered toward a tip side of the insert body, in which a surface of at least the tip portion of the insert body is made of polycrystalline cubic boron nitride compact sintered using a catalytic metal containing Al and at least one selected from the group consisting of Co, Ni, Mn, and Fe and containing 70 vol % to 95 vol % of cubic boron nitride.

A drill bit according to another embodiment of the present invention (hereinafter, referred to as "drill bit of the present invention") includes: a bit body; and the drill bit insert attached to a tip portion of the bit body.

A polycrystalline cubic boron nitride compact with a high cubic boron nitride content has a hardness comparable to Hv hardness of 3.5 GPa to 4.2 GPa of a polycrystalline diamond compact of a drill bit insert for a mining tool and has higher toughness than the polycrystalline diamond compact, whereby there is little concern that unexpected fractures may be caused even in drilling of a super-hard rock layer. Accordingly, in a case of a drill bit insert in which such a polycrystalline cubic boron nitride compact is formed on at least a tip portion of an insert body involved with the drilling, the tool life thereof can be increased, and a drill bit with such a drill bit insert buried in a tip portion thereof can efficiently perform drilling tasks with a reduced exchange frequency.

In addition, since the polycrystalline cubic boron nitride compact has low affinity to Fe or Ni, and a heat resistant temperature thereof is as high as 1,100° C., it can cope with a wide range of drilling conditions. In addition, the polycrystalline cubic boron nitride compact can be ground by a diamond grinding stone. Therefore, in a case where wear proceeds to some extent and the shape is distorted, the polycrystalline cubic boron nitride compact can be resharpened and effectively reused before fractures and the like are caused.

Here, in a case where a cubic boron nitride content in the polycrystalline cubic boron nitride compact is less than 70 vol %, a ratio of direct bonding between cubic boron nitride particles decreases, and thus desired hardness cannot be obtained. In contrast, in a case where the cubic boron nitride content is greater than 95 vol %, the catalytic metal content is reduced and the catalytic metal is not distributed over the whole sintered compact. As a result, unreacted cubic boron nitride particles are generated, and a nonuniform sintered compact is formed. Therefore, early wear occurs due to the fall-off of the particles.

Among the above-described catalytic metals, Al is essential, and at least one of Co, Ni, Mn, and Fe has to be contained. A polycrystalline cubic boron nitride compact sintered using the catalytic metal (binder) has lower heat resistance but higher wear resistance and toughness compared to a polycrystalline cubic boron nitride compact sintered using a ceramic binder such as TiC, TiN, AlN, and $Al_2O_3$ used in cutting of, for example, hardened steel, and thus is excellent as a drill bit insert, in particular, used in percussion drilling.

The polycrystalline cubic boron nitride compact may contain, in addition to these catalytic metals, a metallic additive containing at least one selected from the group consisting of W, Mo, Cr, V, Zr and Hf in order to promote a sintering reaction.

By adding the metal additive, for example, it is possible to suppress the occurrence of abnormal particle growth during the sintering reaction. In addition, since a metallic boride is generated as a reaction product, a harder sintered compact can be formed. Under the same sintering conditions (pressure and temperature), cBN particles are easily bonded to each other, and thus a harder sintered compact can be obtained.

In the polycrystalline cubic boron nitride compact, a portion other than cubic boron nitride is 5 to 30 vol % of the polycrystalline cubic boron nitride compact. The portion other than cubic boron nitride may be made of the catalytic metal and the metallic additive containing one or more of W, Mo, Cr, V, Zr and Hf. The catalytic metal content in the portion other than cubic boron nitride may be 64 wt % to 100 wt %, and the metallic additive content in the portion other than cubic boron nitride may be 0 wt % to 36 wt %.

In addition, the catalytic metal content in the portion other than cubic boron nitride may be 64 wt % to 90 wt %, the metallic additive content in the portion other than cubic boron nitride may be 10 wt % to 36 wt %, and the Al content in the catalytic metal may be 10 wt % to 14 wt %.

By using an appropriate content of the catalytic metal and an appropriate content of the metallic additive in combination, required sintering conditions are relaxed, and hardness of the polycrystalline cubic boron nitride compact is improved.

In case where the Al content is too small, a large amount of oxygen present on the surfaces of cBN particles cannot be completely removed, and thus bonding between cBN particles is disturbed. In a case where the Al content is too large, a large amount of a reaction product such as $AlB_2$, AlN, and $Al_2O_3$ is generated on boundaries between the cBN particles, and a ceramic binder cBN compact with low hardness is formed.

It is desirable that a particle diameter of the cubic boron nitride is 0.5 μm to 60 μm in the polycrystalline cubic boron nitride compact. In a case where the particle diameter of the cubic boron nitride particle is less than 0.5 μm, there is a concern that a sintered compact having a uniform fine structure may not be obtained. In a case where the particle diameter of the cubic boron nitride particle is greater than 60 μm, the specific surface area of the particle is reduced, and thus there is a concern that the catalytic metal content is reduced and the toughness may be reduced. It is necessary that the average particle diameter of a powder of cubic boron nitride particles is 0.5 μm to 60 μm as a whole. However, it is not necessary that the number of peaks of a particle diameter distribution frequency is one (the diameter shows monomodal particle size distribution), and a cubic boron nitride particle powder with a plurality of peaks of the particle diameter distribution frequency (multimodal frequency particle size distribution) can be used. In this case, particles with a small particle diameter enter gaps between particles with a large particle diameter and thus the gaps can be reduced. Therefore, the sintered compact is further densified.

It is desirable that Hv hardness of the polycrystalline cubic boron nitride compact sintered as described above is 3.5 GPa to 4.4 GPa. In a case where the Hv hardness is less than 3.5 GPa, there is a concern that the wear resistance may become insufficient. In contrast, in a case where the Hv hardness is greater than 4.4 GPa, there is a concern that the toughness may be impaired and thus sufficient fracture resistance may not be obtained.

Similarly, it is desirable that a fracture toughness value $K_IC$ of the polycrystalline cubic boron nitride compact is 7 $MPa \cdot m^{1/2}$ to 12 $MPa \cdot m^{1/2}$. In a case where the fracture toughness value $K_IC$ is less than 7 $MPa \cdot m^{1/2}$, there is a concern that the fracture resistance may become insufficient. In contrast, in a case where the fracture toughness value $K_IC$ is greater than 12 $MPa \cdot m^{1/2}$, there is a concern that the wear resistance may become insufficient.

Advantageous Effects of Invention

As described above, according to a drill bit insert and a drill bit of the present invention, it is possible to satisfy both of wear resistance and fracture resistance and thereby prevent the drill bit insert from being fractured or chipping unexpectedly even in a super-hard rock layer. Additionally, it is possible to use the drill bit insert under a wide range of drilling conditions, and effectively reuse the drill bit insert by resharpening.

DETAILED DESCRIPTION OF THE INVENTION

Figure 1:
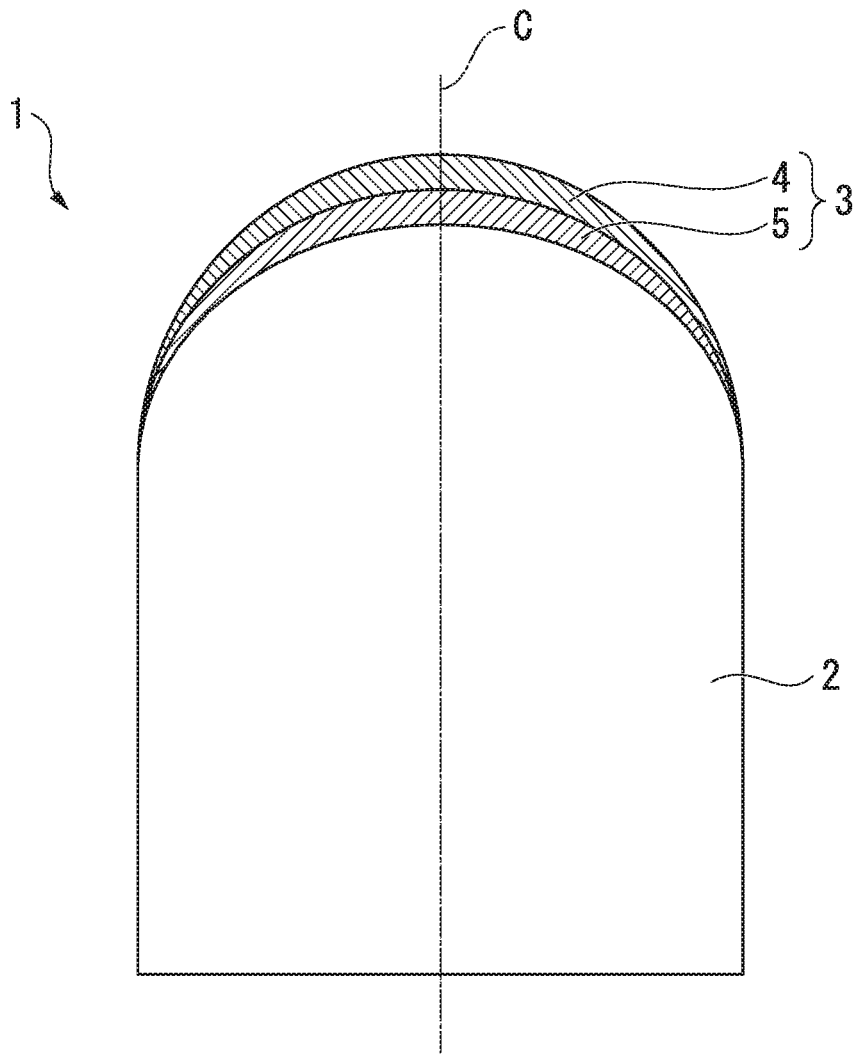
FIG. 1 is a cross-sectional view showing an embodiment of a drill bit insert of the present invention.
Figure 2:
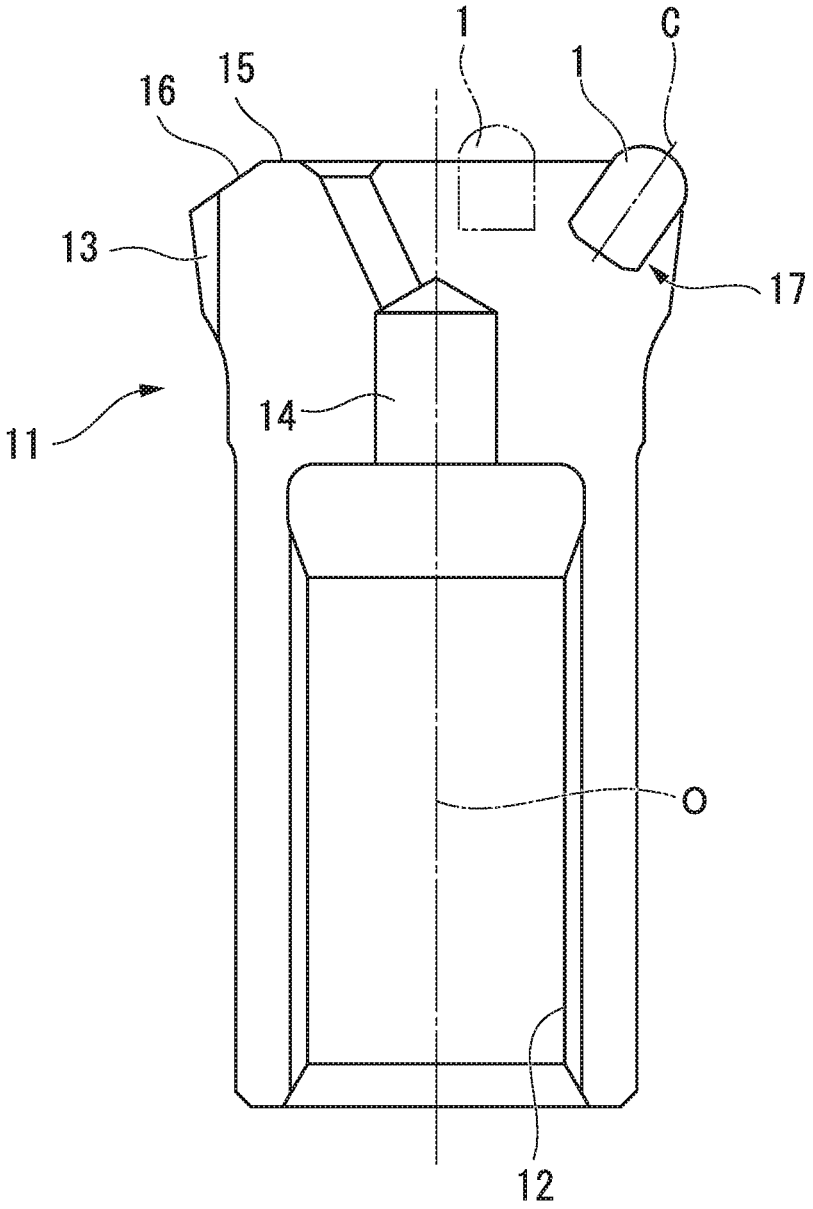
FIG. 2 is a cross-sectional view showing an embodiment of a drill bit of the present invention with the drill bit insert of the embodiment shown in FIG. 1 attached to a tip portion thereof.

FIG. 1 is a cross-sectional view showing an embodiment of a drill bit insert of the present invention. FIG. 2 is a cross-sectional view showing an embodiment of a drill bit of the present invention having the drill bit insert of this embodiment attached thereto. The drill bit insert of this embodiment has an insert body 1. This insert body 1 includes: a body 2 made of a hard material such as a cemented carbide; and a hard layer 3 coated on a surface of at least a tip portion (upper portion in FIG. 1) of the body 2 and having higher hardness (Hv hardness) than that of the body 2.

Hv hardness can be measured through a test method defined in Japanese Industrial Standards (JIS) Z2244.

The insert body 1 includes: a rear end portion (lower portion in FIG. 1) formed in a cylindrical or disk shape centered on a center line C of the insert; and a tip portion formed in a hemispherical shape centered on the center line C of the insert with the same radius as that of the cylindrical or disk shape of the rear end portion in this embodiment and having a tapered shape with the outer diameter from the center line C of the insert gradually reduced toward an tip side. That is, the drill bit insert of this embodiment is a button insert.

In this embodiment, as shown in FIG. 1, only the tip portion of the insert body 1 is coated with the hard layer 3, and the tip portion of the insert body 1 including the hard layer 3 is formed in the above-described hemispherical shape. In addition, in this embodiment, as shown in FIG. 1, the hard layer 3 has a two-layer structure composed of an outermost layer 4 and an intermediate layer 5 interposed between the outermost layer 4 and the body 2.

Although not necessary, a maximum thickness of the outermost layer 4 is preferably 0.3 μm to 1.5 μm, and more preferably 0.4 μm to 1.3 μm.

Similarly, although not necessary, a maximum thickness of the intermediate layer 5 is preferably 0.2 μm to 1.0 μm, and more preferably 0.3 μm to 0.8 μm.

In the hard layer 3, the outermost layer 4 disposed on the surface of the tip portion of the insert body 1 is made of a polycrystalline cubic boron nitride compact sintered using a catalytic metal containing Al and at least one of Co, Ni, Mn, and Fe and containing 70 vol % to 95 vol % of cubic boron nitride. In this embodiment, the intermediate layer 5 is made of a polycrystalline cubic boron nitride compact sintered using the same catalytic metal, but the cubic boron nitride content thereof may be smaller than that of the outermost layer 4.

Although not necessary, the cubic boron nitride content of the intermediate layer 5 is preferably 40 vol % to 70 vol %, and more preferably 45 vol % to 65 vol %.

The particle diameter of the cubic boron nitride is 0.5 μm to 60 μm in the polycrystalline cubic boron nitride compact of the outermost layer 4. The particle diameter of the cubic boron nitride of the intermediate layer 5 is within the same range, but may be smaller than that of the cubic boron nitride of the outermost layer 4. Further, the polycrystalline cubic boron nitride compacts of the outermost layer 4 and the intermediate layer 5 may contain a metallic additive containing at least one of W, Mo, Cr, V, Zr and Hf in addition to the above-described catalytic metal.

In this embodiment, the Hv hardness of the polycrystalline cubic boron nitride compact of the outermost layer 4 formed as described above is 3.5 GPa to 4.4 GPa, and the fracture toughness value $K_IC$ is 7 MPa·m$^{1/2}$ to 12 MPa·m$^{1/2}$. The three-point bending strength TRS of the outermost layer 4, measured using a specimen for TRS formed from a disk-like sample with the same composition as that of the outermost layer 4, is 1.2 GPa to 1.5 GPa.

The fracture toughness value $K_IC$ can be measured through a test method defined in ASTM Standard (ASTM) E399.

The outermost layer 4 can be formed by sintering hexagonal boron nitride under ultrahigh pressure and high temperature conditions, as described in Japanese Patent No. 5613970 of the inventors of the present invention. By integrally sintering the outermost layer 4, the intermediate layer 5, and the body 2 made of a cemented carbide, the insert body 1 of the drill bit insert according to this embodiment can be produced.

The drill bit having such drill bit insert attached to the tip portion thereof has a bit body 11 made of steel or the like and having a substantially bottomed cylindrical shape centered on an axis O as show in FIG. 2. The bottomed portion thereof is the tip portion (upper portion in FIG. 2) to which the drill bit insert is attached. In addition, a female threaded portion 12 is formed on the inner periphery of the cylindrical rear end portion (lower portion in FIG. 2). A drill rod connected to a drilling apparatus is screwed into the female threaded portion 12, and by transmitting a striking force and an impelling force toward the tip side in the direction of the axis O and a rotating force around the axis O thereto, the drill bit insert crushes bedrock to form a borehole.

The tip portion of the bit body 11 has a slightly larger outer diameter than the rear end portion, a plurality of discharge grooves 13 extending in parallel with the axis O are formed on the outer periphery of the tip portion with an interval in the circumferential direction. The drill cuttings generated from the bedrock crushed by the drill bit insert are discharged to a rear end side through the discharge groove 13. In addition, a blow hole 14 is formed along the axis O from the bottom surface of the female threaded portion 12 of the bit body 11 having a bottom. The blow hole 14 branches obliquely at the tip portion of the bit body 11, opens to a tip surface of the bit body 11, and ejects a fluid such as compressed air supplied via the drill rod to promote discharge of drill cuttings.

Furthermore, the tip surface of the bit body 11 has a circular face surface 15 centered on the axis O perpendicular to the axis O on the inner periphery side, and a truncated conical gauge surface 16 located on the outer periphery of the face surface 15 and extending toward the rear end side to be closer to the outer periphery side. The blow hole 14 opens to the face surface 15 and the tip end of the discharge groove 13 opens to the outer periphery side of the gauge surface 16. Further, on the face surface 15 and the gauge surface 16, a plurality of fitting holes 17 having a circular cross-section are formed perpendicularly to the face surface 15 or the gauge surface 16 in a manner that the holes 17 avoid opening portions of the blow hole 14 and the discharge groove 13, respectively.

In such fitting holes 17, in a state where the rear end portion of the insert body 1 is buried as shown in FIG. 2, the drill bit inserts are interference-fitted by press fitting, shrink fitting, or the like, or brazed thereby being fixed to the fitting holes 17, that is, the drill bit inserts are buried in the fitting holes 17 and attached thereto. The tip portion of the insert body 1 having the hard layer 3 formed thereon protrudes from the face surface 15 and the gauge surface 16 and crushes bedrock with the above-described striking force, impelling force, and rotating force.

In the drill bit insert with the above-described configuration, the outermost layer 4 of the hard layer 3 coated on the surface of the tip portion of the insert body 1 involved with the drilling is made of a polycrystalline cubic boron nitride compact with a cubic boron nitride content as high as 70 vol % to 95 vol %. Such a polycrystalline cubic boron nitride compact has Hv hardness comparable to a polycrystalline diamond compact of a drill bit insert for a mining tool as described above, while having the fracture toughness value $K_IC$ higher than that (3 MPa·m$^{1/2}$ to 6 MPa·m$^{1/2}$) of the polycrystalline diamond compact and thus high toughness.

Accordingly, even in a case of drilling a super-hard rock layer, there is little concern that the drill bit insert may be fractured or may chip unexpectedly, and thus the tool life is increased. Thus, it is possible to stably perform drilling over a long period of time. Therefore, in a drill bit having such a drill bit insert attached to a tip portion thereof, the frequency of exchange of the drill bit due to the damage of the drill bit insert is reduced, and thus the time and effort for an exchange operation can be reduced and drilling tasks can be efficiently performed.

Here, in a case where the Hv hardness of the outermost layer 4 is less than 3.5 GPa or the fracture toughness value $K_IC$ is greater than 12 MPa·m$^{1/2}$, there is a concern that the wear resistance may be insufficient. In contrast, in a case where the Hv hardness is greater than 4.4 GPa or the fracture toughness value $K_IC$ is less than 7 MPa·m$^{1/2}$, there is a concern that the toughness may be impaired and thus sufficient fracture resistance may not be obtained. Therefore, as in this embodiment, it is desirable that the Hv hardness is 3.5 GPa to 4.4 GPa, and the fracture toughness value $K_IC$ is 7 MPa·m$^{1/2}$ to 12 MPa·m$^{1/2}$.

In addition, the polycrystalline cubic boron nitride compact has low affinity to Fe or Ni, and therefore drilling can be stably performed over a long period of time even in Fe or Ni mines. Furthermore, since a heat resistant temperature is 1,100° C. higher than that of the polycrystalline diamond compact, the drill bit insert can be used even under drilling conditions where it is exposed to high temperatures. Moreover, the polycrystalline cubic boron nitride compact can be ground by a diamond grinding stone, and thus can be effectively reused by resharpening.

In a case where the cubic boron nitride content of the polycrystalline cubic boron nitride compact in the outermost layer 4 is less than 70 vol %, the ratio of direct bonding between cubic boron nitride particles decreases, and thus it is not possible to obtain Hv hardness necessary for drilling of a super-hard rock layer as described above. In a case where the cubic boron nitride content of the outermost layer 4 is greater than 95 vol %, the catalytic metal content is relatively reduced, the catalytic metal is not distributed over the whole sintered compact, unreacted cubic boron nitride particles are generated, and a nonuniform sintered compact is formed. Such unreacted cubic boron nitride particles fall off and the outermost layer 4 is worn early.

Furthermore, as a catalytic metal, Al (essential) and at least one of Co, Ni, Mn, and Fe are contained. Since a polycrystalline cubic boron nitride compact sintered using such metal binders has higher wear resistance and toughness than a polycrystalline cubic boron nitride compact sintered using a ceramic binder such as TiC, TiN, AlN, and $Al_2O_3$, the above-described effects can be reliably achieved with, in particular, a drill bit insert used in percussion drilling. In addition, in a case where a metallic additive containing at least one of W, Mo, Cr, V, Zr and Hf is contained in addition to the catalytic metals, a sintering reaction of the polycrystalline cubic boron nitride compact can be promoted.

In this embodiment, since the particle diameter of the cubic boron nitride particle is 0.5 μm to 60 μm in the polycrystalline cubic boron nitride compact of the outermost layer 4 of the hard layer 3, a sintered compact with a uniform fine structure can be formed, and toughness can be reliably retained. That is, in a case where the particle diameter of the cubic boron nitride particle of the outermost layer 4 is less than 0.5 μm, there is a concern that the sintered compact has a nonuniform structure and a deviation may be partially caused in hardness and toughness. In a case where the particle diameter of the cubic boron nitride particle is greater than 60 μm, the specific surface area of the particle is reduced, and thus there is a concern that the catalytic metal content is reduced and the toughness may be reduced.

In this embodiment, the hard layer 3 has a two-layer structure composed of the outermost layer 4 and the intermediate layer 5. However, the hard layer 3 may have a single layer structure composed of the outermost layer 4 or a multi-layer structure composed of three or more layers. In a case where the hard layer 3 has a multi-layer structure composed of three or more layers, it is desirable that a layer with a cubic boron nitride content of less than 70 vol %, such as the intermediate layer 5 according to the embodiment, is interposed between the outermost layer 4 and the body 2, and it is desirable that the cubic boron nitride content of the intermediate layer 5 is gradually reduced, and thus the Hv hardness is reduced and the fracture toughness value $K_IC$ is increased toward the body 2 from the outermost layer 4. In a case where the hard layer 3 is formed on the tip portion of the body 2 made of a cemented carbide or the like as in this embodiment, it is desirable that the thickness of the hard layer 3 on the center line C of the insert is 0.8 mm or greater in order to retain a certain level of drilling distance, and also not greater than 2 mm in consideration of residual stress in the hard layer 3 caused by a difference in the shrinkage ratio from the cemented carbide during sintering.

On the other hand, instead of coating the body 2 with the hard layer 3 to form the hard layer 3 on the tip portion of the insert body 1, the entire insert body 1 may be made of the same polycrystalline cubic boron nitride compact as the outermost layer 4. In this case, in order to prevent the insert body 1 from breaking or the like, it is desirable that the fracture toughness value $K_IC$ of the polycrystalline cubic boron nitride compact is set to 10 MPa·m$^{1/2}$ or greater. In a large drill bit insert with an outer diameter of the insert body 1 of 16 mm or greater and a length of the insert body in a direction of the center line C of the insert of 20 mm or greater, it is desirable that the three-point bending strength TRS is 1.3 GPa or greater.

In this embodiment, the case where the present invention is applied to a button type drill bit insert in which the tip portion of the insert body 1 has a hemispherical shape as described above, is described. However, it is possible to apply the present invention to so-called ballistic type drill bit insert in which the tip portion of the insert body 1 forms a bullet-shape, and to a so-called spike type drill bit insert in which the rear end side of the tip portion has a conical surface shape and decreases in diameter toward the tip side, and of which a tip end has a spherical shape with a smaller radius than that of the cylindrical rear end portion of the insert body 1.

Examples

Next, the effects of the present invention will be verified with examples of a drill bit insert and a drill bit of the present invention. In the examples, based on the embodiments, a hard layer in which a cubic boron nitride (cBN) content of a polycrystalline cubic boron nitride compact, a catalytic metal type, and a composition were changed was sintered integrally with a body made of a cemented carbide containing 94 wt % of WC and 6 wt % of Co under conditions where sintering pressure was 5.8 GPa, sintering temperature was 1,600° C., and sintering time 30 minutes, to produce 11 types of button tips with a radius of 5.5 mm and a length of 16 mm in a direction of a center line of the insert. The radius of the hemisphere formed by a tip portion of an insert body was 5.75 mm. The thickness of the hard layer in the direction of the center line of the insert is 1.5 mm. In all of Examples 1, 2, 5, 6, 9, 10, and 11, the hard layer is a single layer composed of an outermost layer. In Examples 3, 4, 7, and 8, the hard layer has an outermost layer and an intermediate layer as in the embodiment shown in FIG. 1. In Example 9, the particle diameter of cubic boron nitride in a polycrystalline cubic boron nitride compact is 60 μm or greater, and in Example 10, the particle diameter is 0.5 μm or less.

As comparative examples with respect to Examples 1 to 11, two types of button inserts (Comparative Examples 1 and 2) having a hard layer composed of a single layer of a polycrystalline diamond compact with different diamond contents, a button insert (Comparative Example 3) of which an entire insert body was made of the same cemented carbide containing 94 wt % of WC and 6 wt % of Co as the body, a button insert (Comparative Example 4) having a hard layer composed of two layers of polycrystalline cubic boron nitride compacts where a cubic boron nitride (cBN) content of an outermost layer was less than 70 vol %, a button insert (Comparative Example 5) where a cubic boron nitride content of an outermost layer was greater than 95 vol %, a button insert (Comparative Example 6) sintered using a ceramic binder (TiC) in place of a catalytic metal, and a button insert (Comparative Example 7) having a hard layer composed of a single layer of a polycrystalline cubic boron nitride compact where a cubic boron nitride content of an outermost layer was greater than 95 vol % and a particle diameter of cubic boron nitride was greater than 60 μm, were produced to have the same size as in Examples 1 to 11. Except for Comparative Example 3, the thickness of the hard layer in the direction of the center line of the insert was 1.5 mm the same as in Examples 1 to 11.

For each type of the drill bit inserts of Examples 1 to 11 and Comparative Examples 1 to 7, two drill bit inserts were attached to a face surface of a bit body having a bit diameter of 45 mm as shown in FIG. 2, and five drill bit inserts were attached to a gauge surface thereof to produce 18 types of drill bits where a total of seven drill bit inserts are attached. Using these drill bits, drilling tasks were performed to form a plurality of boreholes with a drilling length of 4 m in a mine made of super-hard rock layers and having an average uniaxial compressive strength of 200 MPa. The total drilling length (m) until the drill bit insert reached the end of the tool life was measured, and a damaged state of the insert when the drill bit insert reached the end of the tool life was confirmed.

Drilling conditions were as follows: a drilling apparatus was model No. H205D manufactured by TAMROCK Co., Ltd., striking pressure was 160 bar, feed pressure was 80 bar, rotational pressure was 55 bar, and a water with pressure of 18 bar was supplied from the blow hole. The results of Examples 1 to 4 are shown in Table 1, the results of Examples 5 to 11 are shown in Table 2, and the results of Comparative Example 1 to 7 are shown in Table 3, together with compositions of hard layers of the respective drill bit inserts, and Hv hardness and fracture toughness values $K_IC$ of the outermost layers thereof.

TABLE 1

| No: | Composition of outermost layer | Composition of intermediate layer | Hv hardness of outermost layer (GPa) | Fracture toughness value $K_IC$ of outermost layer (MPa · $m^{1/2}$) | Drilling length until end of tool life was reached (m) | Insert damaged state |
|---|---|---|---|---|---|---|
| Example 1 | 90 vol % cBN (80 vol % 20/40μ + 20 vol % 2/4μ) + 10 vol % (70Co20W10Al wt %) | None | 4 | 9 | 288 | Normal wear |
| Example 2 | 82 vol % cBN (0.5/1.3μ) + 18 vol % (60Co20Ni13V7Al wt %) | None | 4.2 | 10 | 320 | Normal wear |
| Example 3 | 85 vol % cBN (4/8μ) + 15 vol % (50Co20Cr16Mo14Al wt %) | 55 vol % cBN (2/4μ) + 35 vol % WC + 10 vol % (70Co20W10Al wt %) | 3.7 | 10.5 | 256 | Normal wear |
| Example 4 | 92 vol % cBN (10/20μ) + 8 vol % (47Fe21Mn19Zr13Al wt %) | 55 vol % cBN (2/4μ) + 35 vol % WC + 10 vol % (70Co20W10Al wt %) | 3.9 | 8.5 | 308 | Normal wear |

TABLE 2

| No: | Composition of outermost layer | Composition of intermediate layer | Hv hardness of outermost layer (GPa) | Fracture toughness value $K_IC$ of outermost layer (MPa · $m^{1/2}$) | Drilling length until end of tool life was reached (m) | Insert damaged state |
|---|---|---|---|---|---|---|
| Example 5 | 86 vol % cBN (80 vol % 20/40μ + 20 vol % 2/4μ) + 14 vol % (50Co50Al wt %) | None | 3.7 | 8.7 | 216 | Normal wear |
| Example 6 | 89 vol % cBN (0.5 to 1.3μ) + 11 vol % (80Co10V10Al wt %) | None | 3.9 | 11.2 | 336 | Normal wear |
| Example 7 | 75 vol % cBN (4 to 8μ) + 25 vol % (70Co22Cr8Al wt %) | 55 vol % cBN (2/4μ) + 35 vol % WC + 10 vol % (70Co20W10Al wt %) | 3.5 | 10.8 | 236 | Normal wear |
| Example 8 | 79 vol % cBN (10 to 20μ) + 21 vol % (60Ni40Al wt %) | 55 vol % cBN (2/4μ) + 35 vol % WC + 10 vol % (70Co20W10Al wt %) | 3.6 | 8.1 | 204 | Normal wear |
| Example 9 | 90 vol % cBN (60/80μ) + 10 vol % (47Fe21Mn19Zr13Al wt %) | None | 4.2 | 4.6 | 184 | Chipping |

TABLE 2-continued

| No: | Composition of outermost layer | Composition of intermediate layer | Hv hardness of outermost layer (GPa) | Fracture toughness value $K_IC$ of outermost layer (MPa · $m^{1/2}$) | Drilling length until end of tool life was reached (m) | Insert damaged state |
|---|---|---|---|---|---|---|
| Example 10 | 85 vol % cBN (0/0.5μ) + 15 vol % (47Fe21Mn19Zr13Al wt %) | None | 3.8 | 9.1 | 192 | Normal wear and partial chipping |
| Example 11 | 82 vol % cBN (6/12μ) + 18 vol % (82Co6Hf12Al wt %) | None | 3.6 | 9.8 | 232 | Normal wear |

TABLE 3

| No: | Composition of outermost layer | Composition of intermediate layer | Hv hardness of outermost layer (GPa) | Fracture toughness value $K_IC$ of outermost layer (MPa · $m^{1/2}$) | Drilling length until end of tool life was reached (m) | Insert damaged state |
|---|---|---|---|---|---|---|
| Comparative Example 1 | 85 vol % Diamond (6/12μ) + 15 vol % Co | None | 4.4 | 4.5 | 176 | Chipping |
| Comparative Example 2 | 55 vol % Diamond (6/12μ) + 35 vol % WC + 10 vol % Co | None | 3.5 | 9.1 | 168 | Partial chipping |
| Comparative Example 3 | WC 94 wt % + Co 6 wt % | None | 1.3 | 14.7 | 16 | Normal wear |
| Comparative Example 4 | 60 vol % cBN (0.5/1.3μ) + 40 vol % (60Co20Ni13V7Al wt %) | 55 vol % cBN (2/4μ) + 35 vol % WC + 10 vol % (70Co20W10Al wt %) | 2.5 | 12 | 64 | Normal wear |
| Comparative Example 5 | 98 vol % cBN (0/1μ) + 2 vol % (47Fe21Mn19Zr13Al wt %) | 55 vol % cBN (2/4μ) + 35 vol % WC + 10 vol % (70Co20W10Al wt %) | 1.9 | 6.5 | 24 | Fall-off of particles (early wear) |
| Comparative Example 6 | 50 vol % cBN (1/2μ) + 40 vol % TiC + 6 vol % WC + 4 vol % Al | None | 3.6 | 7.2 | 20 | Chipping |
| Comparative Example 7 | 98 vol % cBN (80/100μ) + 2 vol % (47Fe21Mn19Zr13Al wt %) | None | 4.4 | 4.2 | 8 | Early wear and chipping |

From the results, in the drill bits having the drill bit inserts of Comparative Examples 1 to 7 attached thereto, respectively, the drilling length was 176 m even in Comparative Example 1 in which the hard layer was a polycrystalline diamond compact and the drilling distance was long, the end of the tool life was reached due to chipping in Comparative Examples 1 and 2, and the drilling length did not reach 100 m in Comparative Examples 3 to 7. Among these, even in Comparative Examples 4 to 6 where the hard layer was a polycrystalline cubic boron nitride compact, in Comparative Example 4, wear was significantly occurred since the polycrystalline cubic boron nitride compact had a small cubic boron nitride content. In contrast, in Comparative Examples 5 and 7 where the cubic boron nitride content was tool large, the catalytic metal content was insufficient, and a nonuniform structure was thus formed. Therefore, cubic boron nitride particles fell off and early wear occurred. Moreover, chipping also occurred in Comparative Example 7 where the cubic boron nitride particles had a large particle diameter. Furthermore, also in Comparative Example 6 where the polycrystalline cubic boron nitride compact was sintered using a ceramic binder in place of a catalytic metal, the end of the tool life was reached due to chipping. In Comparative Example 6, the drilling length until the end of the tool life was reached was 20 m, and two reasons for this are considered. A first reason is that the polycrystalline cubic boron nitride compact is sintered using a ceramic binder in place of a catalytic metal in Comparative Example 6. A second reason is that a intermediate layer is not provided in Comparative Example 6. In this case, an outermost layer having a thermal expansion rate extremely different from the drill bit insert body is directly provided on a tip portion of the insert body. Therefore, large stress is generated at an interface between the tip portion and the outermost layer due to heat generated during drilling, and causes chipping.

In the drill bits having the drill bit inserts of Examples 1 to 8 and 11 attached thereto, respectively, the wear state was normal wear in all of the cases. Even in Example 8 where the drilling length was the shortest, 200 m or more of drilling was possible, and in Examples 2, 4, and 6, 300 m or more of drilling was possible. In Example 9 where the particle diameter of the cubic boron nitride particle in the polycrystalline cubic boron nitride compact was 60 μm or greater and in Example 10 where the particle diameter was 0.5 μm or less, chipping was recognized and the drilling length did not reached 200 m. However, the drilling length is longer than in Comparative Examples 1 to 7.

INDUSTRIAL APPLICABILITY

As described above, according to the present invention, it is possible to satisfy both of wear resistance and fracture resistance and thereby prevent a drill bit insert from being fractured or chipping unexpectedly even in a super-hard rock layer. Additionally, it is possible to use the drill bit insert under a wide range of drilling conditions, and effectively reuse the drill bit insert by resharpening.

REFERENCE SIGNS LIST

1: INSERT BODY
2: BODY
3: HARD LAYER
4: OUTERMOST LAYER
5: INTERMEDIATE LAYER
11: BIT BODY
C: CENTER LINE OF INSERT
O: AXIS OF BIT BODY 11

The invention claimed is:

1. A drill bit insert attached to a tip portion of a drill bit to perform drilling, the drill bit insert comprising:

an insert body that has:

a rear end portion buried in a bit body of the drill bit; and a tip portion protruding from a surface of the drill bit and tapered toward a tip side of the insert body, wherein a surface of at least the tip portion of the insert body is made of polycrystalline cubic boron nitride compact sintered using a catalytic metal containing Al and at least one selected from the group consisting of Co, Ni, Mn, and Fe and containing 70 vol % to 95 vol % of cubic boron nitride, and Hv hardness of the polycrystalline cubic boron nitride compact is 3.5 GPa to 4.4 GPa.

2. The drill bit insert according to claim 1, wherein a particle diameter of the cubic boron nitride is 0.5 μm to 60 μm in the polycrystalline cubic boron nitride compact.

3. The drill bit insert according to claim 2, wherein the polycrystalline cubic boron nitride compact contains a metallic additive containing at least one selected from the group consisting of W, Mo, Cr, V, Zr and Hf.

4. The drill bit insert according to claim 2, wherein a fracture toughness value $K_IC$ of the polycrystalline cubic boron nitride compact is 7 $MPa \cdot m^{1/2}$ to 12 $MPa \cdot m^{1/2}$.

5. The drill bit insert according to claim 1, wherein the polycrystalline cubic boron nitride compact contains a metallic additive containing at least one selected from the group consisting of W, Mo, Cr, V, Zr and Hf.

6. The drill bit insert according to claim 5 wherein a fracture toughness value $K_IC$ of the polycrystalline cubic boron nitride compact is 7 $MPa \cdot m^{1/2}$ to 12 $MPa \cdot m^{1/2}$.

7. The drill bit insert according to claim 1, wherein a fracture toughness value $K_IC$ of the polycrystalline cubic boron nitride compact is 7 $MPa \cdot m^{1/2}$ to 12 $MPa \cdot m^{1/2}$.

8. A drill bit comprising:

a bit body; and the drill bit insert according to claim 1 attached to a tip portion of the bit body.

* * * * *